US008348471B2

(12) United States Patent
Huang et al.

(10) Patent No.: US 8,348,471 B2
(45) Date of Patent: Jan. 8, 2013

(54) LED LAMP ASSEMBLY

(75) Inventors: Tsung-Chin Huang, Taipei Hsien (TW); Chang Hung Peng, Taipei Hsien (TW)

(73) Assignee: Cooler Master Co., Ltd., Taipei Hsien (TW)

( * ) Notice: Subject to any disclaimer, the term of this patent is extended or adjusted under 35 U.S.C. 154(b) by 255 days.

(21) Appl. No.: 12/647,779

(22) Filed: Dec. 28, 2009

(65) Prior Publication Data

US 2010/0164348 A1 Jul. 1, 2010

(30) Foreign Application Priority Data

Dec. 29, 2008 (TW) ..... 97223550 U

(51) Int. Cl.
*F21V 29/00* (2006.01)
*F21V 21/00* (2006.01)
*F21S 4/00* (2006.01)

(52) U.S. Cl. ..... 362/294; 362/650

(58) Field of Classification Search ..... 362/294, 362/373, 249.02, 647, 649, 650, 651, 652, 362/567, 568, 569; 313/46, 318.09, 318.1
See application file for complete search history.

(56) References Cited

U.S. PATENT DOCUMENTS

| | | | | |
|---|---|---|---|---|
| 7,748,870 | B2 * | 7/2010 | Chang et al. | 362/294 |
| 7,943,952 | B2 * | 5/2011 | Loh et al. | 257/100 |
| 2005/0174780 | A1 * | 8/2005 | Park | 362/294 |
| 2008/0158887 | A1 * | 7/2008 | Zhu et al. | 362/294 |
| 2009/0141500 | A1 * | 6/2009 | Peng | 362/294 |
| 2010/0002453 | A1 * | 1/2010 | Wu et al. | 362/373 |
| 2010/0109499 | A1 * | 5/2010 | Vilgiate et al. | 313/1 |

* cited by examiner

*Primary Examiner* — David Crowe
(74) *Attorney, Agent, or Firm* — Rosenberg, Klein & Lee

(57) ABSTRACT

A LED lamp assembly is disclosed. The LED lamp assembly includes a heat radiator, a base body and a cover body. The base body is located on one end of the heat radiator and the cover body is located on the other end of the heat radiator. The base body has a plurality of first engaging parts, each of which is associated with a first engaging portion. The cover body has a plurality of second engaging parts, each of which is associated with a second engaging portion. The first engaging portion is configured to correspond to and engage with the second engaging portion so as to sandwich the heat radiator between the base body and the cover body.

7 Claims, 5 Drawing Sheets

LED LAMP ASSEMBLY

BACKGROUND OF THE INVENTION

1. Field of the Invention

The present invention relates to a LED lamp assembly, and more particularly to a LED lamp assembly which utilizes light-emitting diodes to emit light and can be assembled rapidly and conveniently without a screw.

2. Description of Related Art

Since light emitting diodes (LED) not only have rapidly improved photoelectric conversion efficiency, but also have the advantages of small volume, high efficiency, low energy consumption, low heat quantity and so on, they are regarded as lighting sources with great potential in future. Currently, LEDs have been widely used in various industrial and commercial products such as traffic signal lights, automobile lamps, lamp screens on external walls of buildings, electronic advertisement boards, projecting lamps and so on. Compared with traditional tungsten bulbs, which are with the disadvantages of high energy consumption, short service life and violation of environmental requirements, the LEDs having the aforementioned advantages has been developed to replace the traditional tungsten bulbs.

In addition to the LEDs, conventional LED lamp assembly structures further include heat radiators for heat radiation to reduce the phenomena of high temperature thermal energy produced by the LEDs during their operations. Moreover, the conventional LED lamp assembly includes a base body fixed at one end of a base of the heat radiator via components such as screws or rivets and a cover body fixed at the other end thereof via the similar components. Consequently, such lamp assembly requires a large amount of screws or rivets over the course of the assembly, which complicates the entire process of the assembly and is more costly.

SUMMARY OF THE INVENTION

A main objective of the present invention is to provide a LED lamp assembly which can be assembled in a single assembly operation eliminating the usage of large amount of screws and rivets.

To achieve the above-mentioned objective, a LED lamp assembly in accordance with the present invention includes a heat radiator; a base body located on one end of the heat radiator and having a plurality of first engaging parts each associated with a first engaging portion, and a cover body located on the other end of the heat radiator and having a plurality of second engaging parts each associated with a second engaging portion. The second engaging portions of the second engaging parts correspond to and are configured to engage with their respective first engaging portions of the first engaging parts in order to sandwich the heat radiator between the base body and cover body.

To further understand features and technical contents of the present invention, please refer to the following detailed description and drawings related the present invention. However, the drawings are only to be used as references and explanations, not to limit the present invention.

DETAILED DESCRIPTION OF THE PREFERRED EMBODIMENTS

Figure 1:
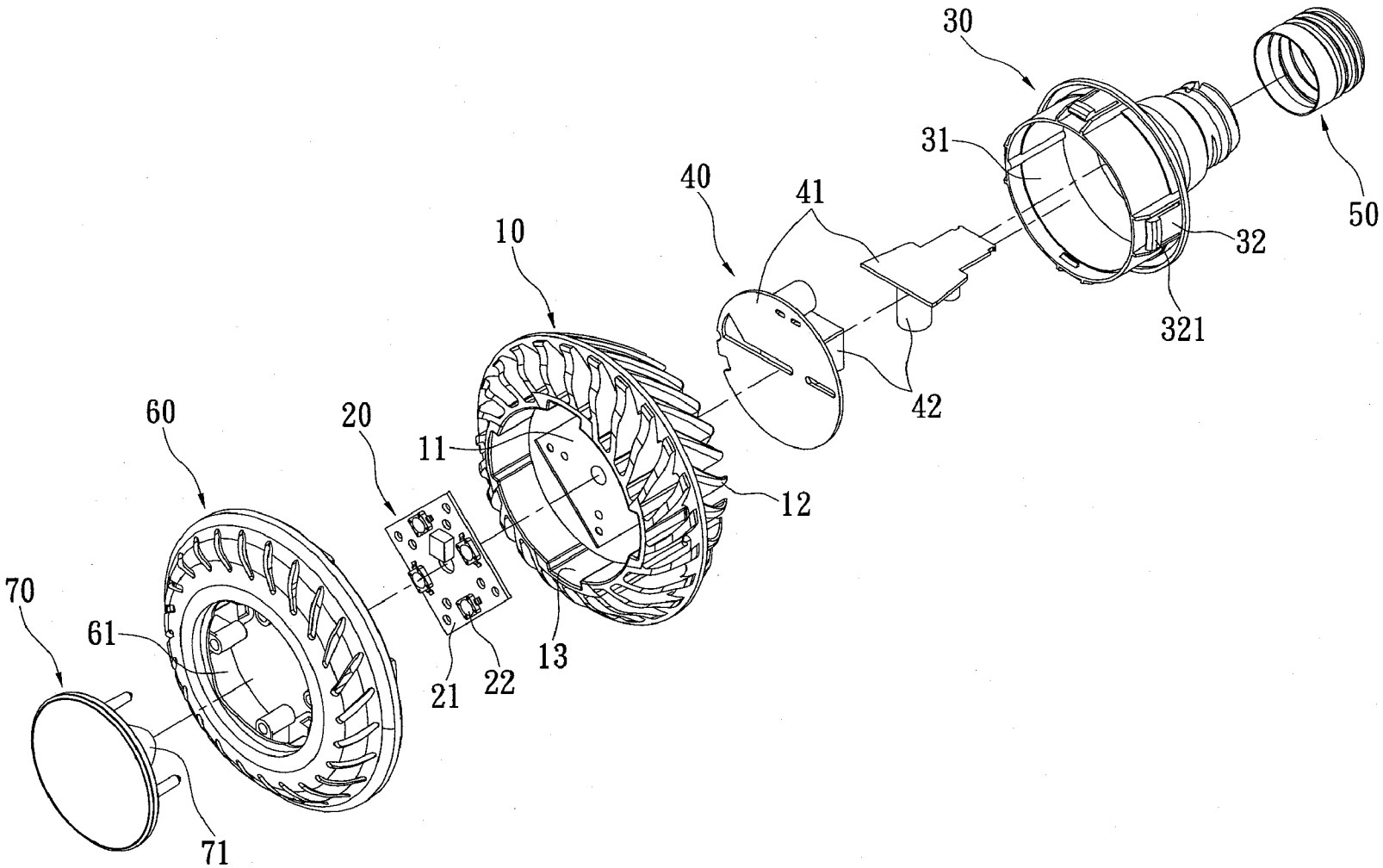
FIG. 1 is an exploded perspective view of a LED lamp assembly according to one embodiment of the present invention.
Figure 2:
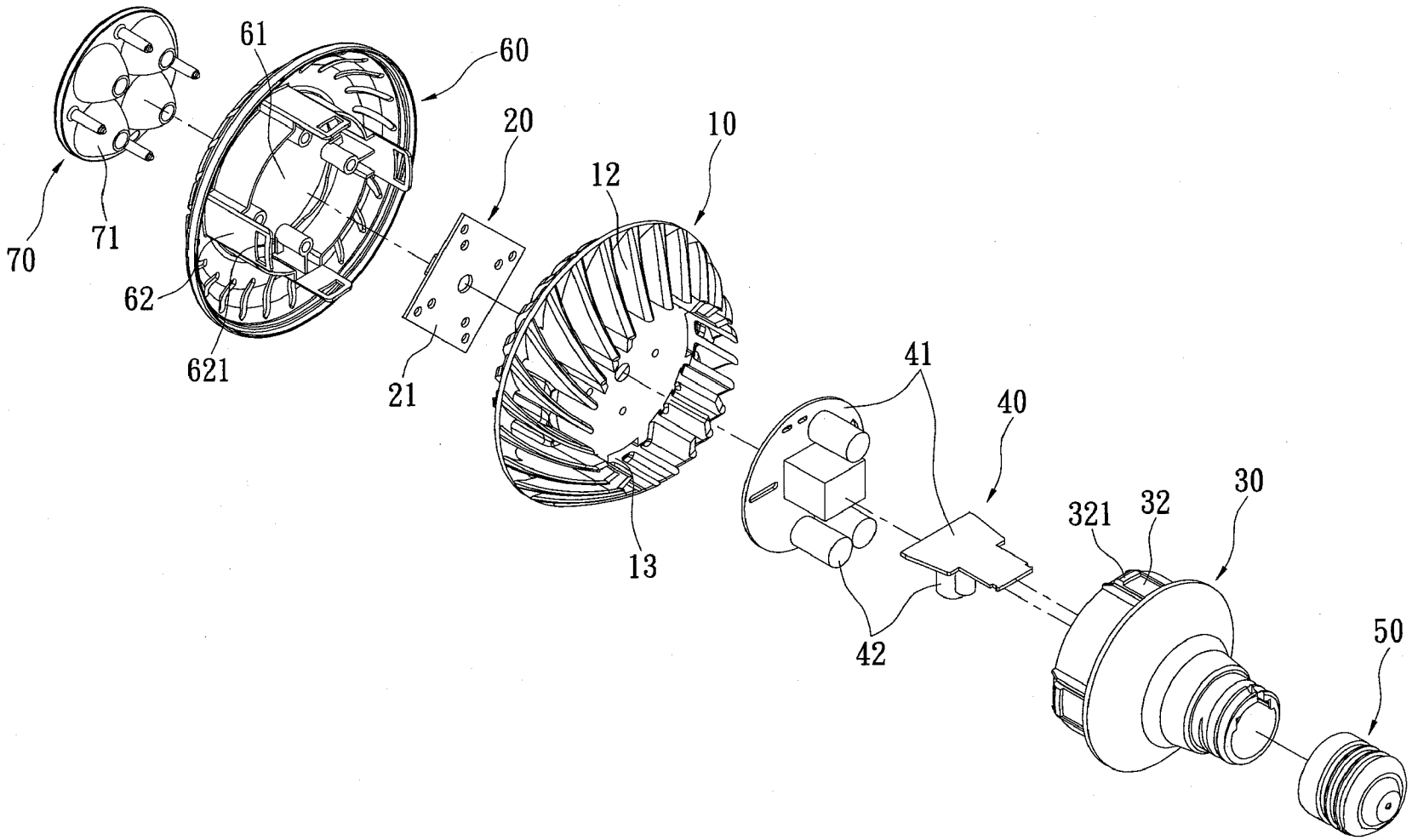
FIG. 2 is an exploded perspective view of the LED lamp assembly according to one embodiment of the present invention.

Please refer to FIGS. 1 and 2 as exploded perspective views of a LED lamp assembly according to one embodiment of the present invention. The LED lamp assembly includes a heat radiator 10, a light emitting module 20, a base body 30, a driving circuit unit 40, a conductive joint 50, a cover body 60 and a lens 70.

The heat radiator 10 is made of a conductive material and has a receiving portion 11 formed in a front end thereof and a plurality of radiating fins 12 for heat radiation extending outwardly from the periphery of the heat radiator 10.

The light emitting module 20 includes a circuit board 21 and a plurality of light-emitting diodes 22 disposed on a front end face of the circuit board 21.

The base body 30 is configured to form a receiving space 31. The base body 30 is further configured to form a plurality of first engaging parts 32 arranged at intervals on a periphery of the base body 30. Each first engaging part 32 has a first engaging portion 321. In one implementation, the number of the first engaging parts 32 is, but not limited to, four. In another implementation, each first engaging part 321 is, but not limited to, a fastener.

The driving circuit unit 40 includes at least one circuit board 41 and a plurality of electronic components 42. In one implementation, the number of the circuit board 41 is two, and the electronic components 42 are respectively disposed on the two circuit boards 41. Therefore, the two circuit boards 41 could be connected via the electronic components 42 for driving the light emitting module 20 to emit light.

The conductive joint 50 is assembled on one end of the base body 30. The conductive joint 50 and the base body 30 may be manufactured according to the specification of metal screw adapters of traditional tungsten bulbs so that the base body 30 could be connected to an external electrical outlet. The conductive joint 50 is electrically connected with the driving circuit unit 40 and the light emitting module 20 respectively. Therefore, the driving circuit 40, upon the connection with the external electrical outlet through the conductive joint 50, can receive and convert the voltage output of the external electric outlet before providing the light-emitting diodes 22 with a desired voltage. Plus, the driving circuit unit 40 and the light emitting module 20 may be respectively electrically connected with the conductive joint 50 via electrical wires (not shown).

The cover body 60 has a through-hole 61 defined in the center thereof. The cover body 60 is configured to form a plurality of second engaging parts 62 arranged at intervals on the peripheral of the cover body 60. Each second engaging part 62 has a respective second engaging portion 621. In one implementation, the number of the second engaging parts 62 is, but not limited to, four. In another implementation, each second engaging part 621 is, but not limited to, a fastening hole. The heat radiator 10 has a plurality of grooves 13 for receiving the second engaging parts 62 so as to facilitate an engagement between the heat radiator 10 and the cover body 60.

The lens 70 is made of a transparent material. The lens 70 has a plurality of light guiding portions 71. Each light guiding portion 71 corresponds to the light-emitting diode 22, so that the light from the light-emitting diodes 22 can be emitted more effectively and has a larger irradiation range.

Figure 3:
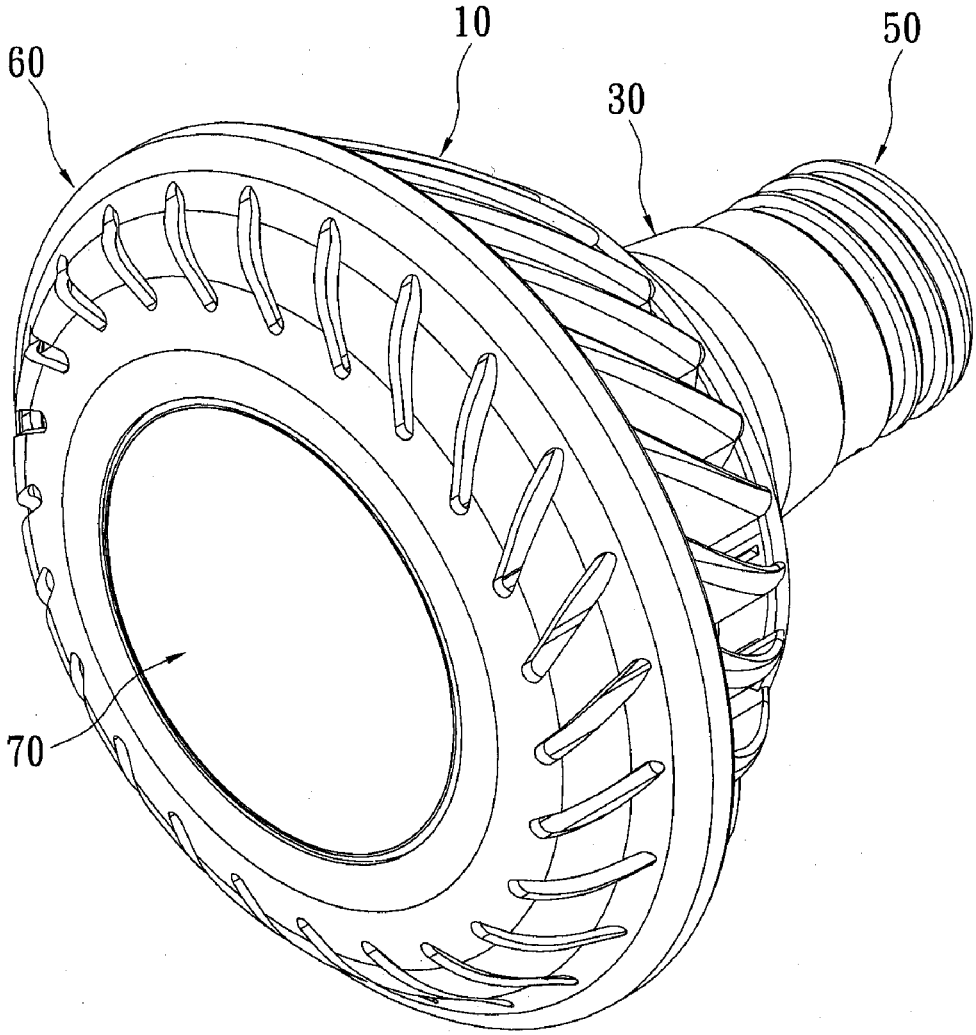
FIG. 3 is an assembled perspective view of the LED lamp assembly according to one embodiment of the present invention.
Figure 4:
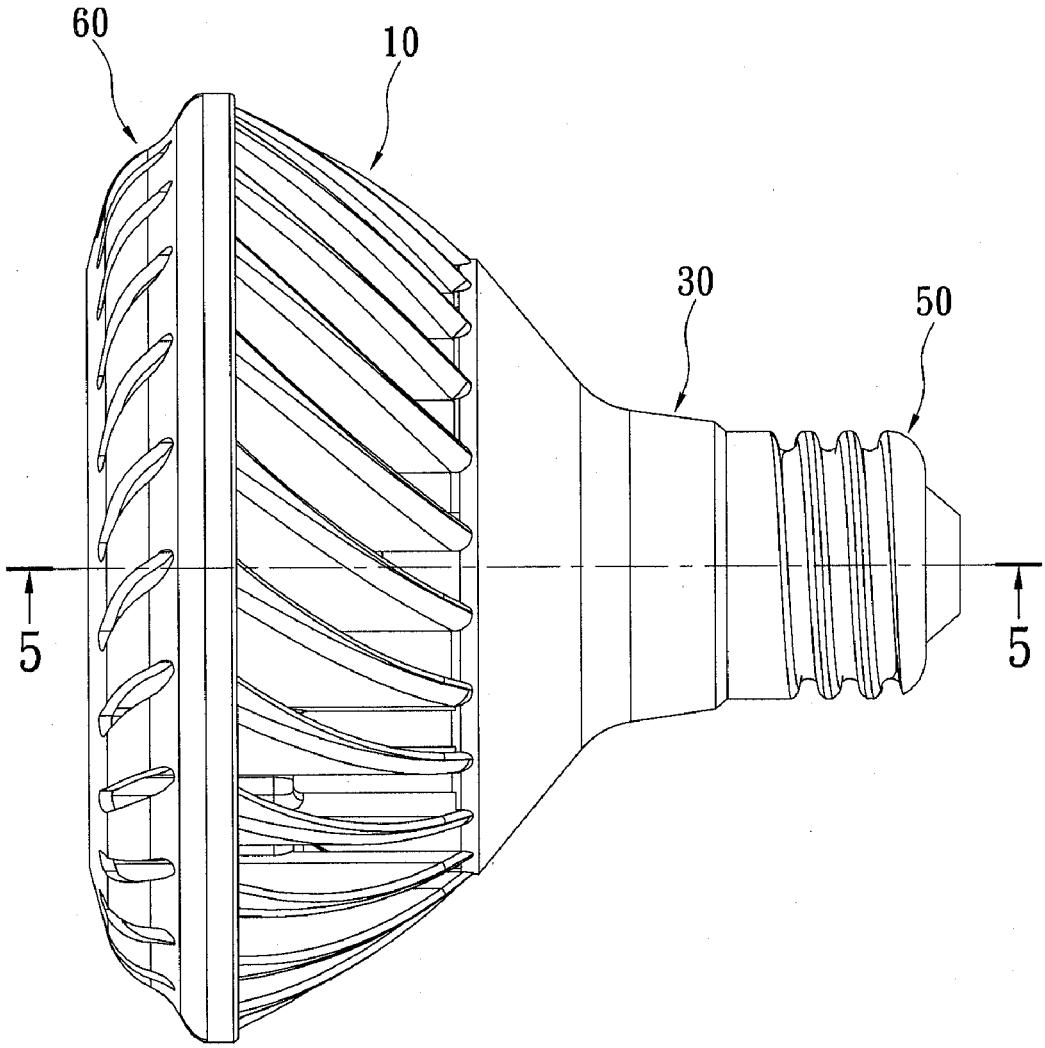
FIG. 4 is a top view of the LED lamp assembly shown in FIG. 3.
Figure 5:
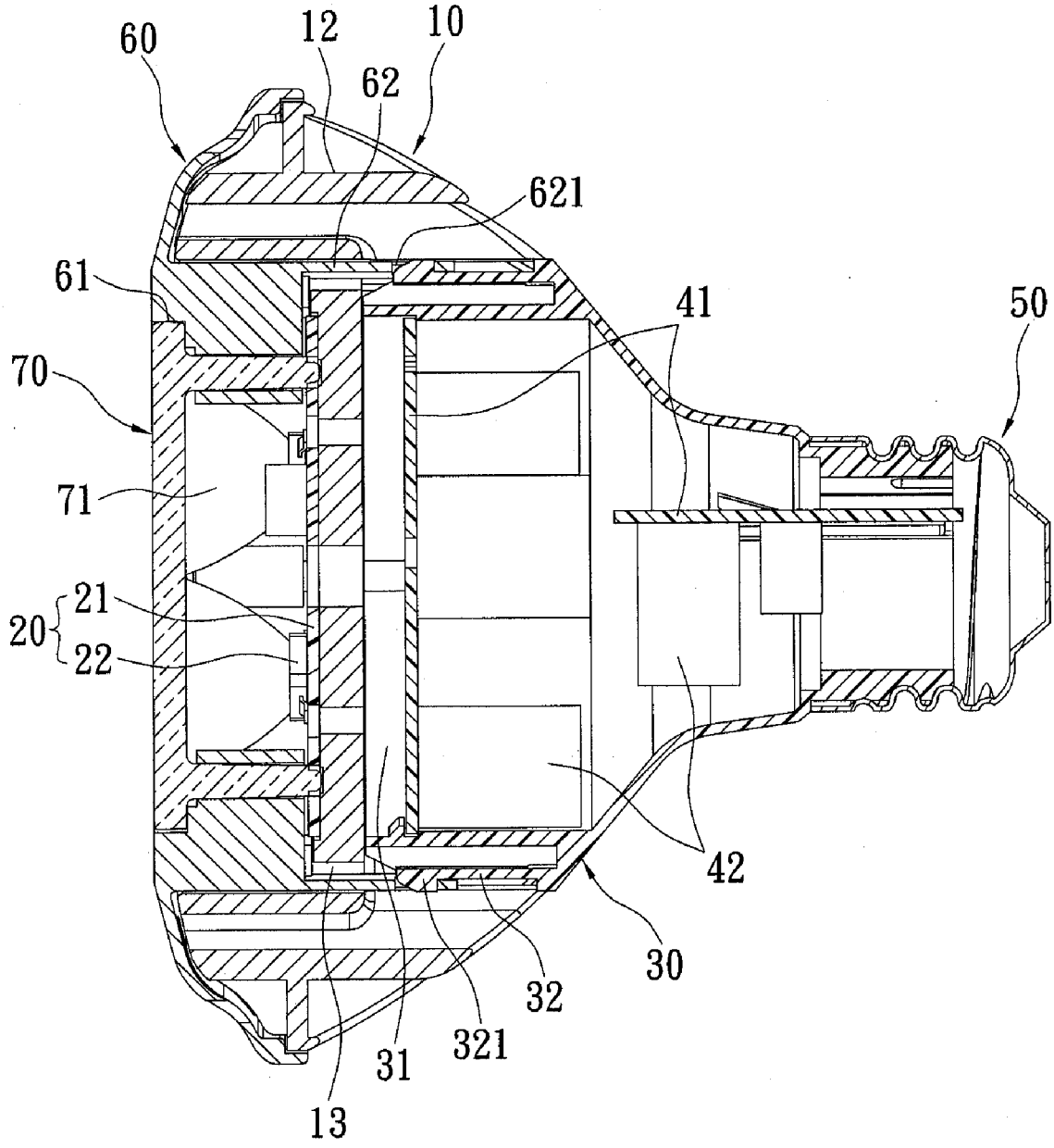
FIG. 5 is a cross-sectional view of the LED assembly along line 5-5 of FIG. 4.

In conjunction with FIGS. 1 and 2, FIG. 3 is an assembled perspective view of the LED lamp assembly according to one embodiment of the present invention. FIG. 4 is a top view of the LED lamp assembly shown in FIG. 3. And FIG. 5 is a cross-sectional view of the LED assembly along line 5-5 of FIG. 4. In FIGS. 1 and 2, the light emitting module 20 is configured to be received by the receiving portion 11 of the heat radiator 10. The rear end face of the circuit board 21 is attached to the inner wall of the receiving portion 11 of the heat radiator 10 so that the heat produced by the light-emitting diodes 22 can be conducted to the radiating fins 12 and then dissipate through air convection generated between the radiating fins 12.

The driving circuit unit 40 is received in the receiving space 31 of the base body 30. Heat conduction glue (not shown) may be poured onto an inner wall that defines the receiving space 31. Consequently, the driving circuit unit 40 could be bonded with the base body 30 and heat generated by the driving circuit unit 40 could be conducted. The conductive joint 50 is assembled on the rear of the base body 30. The conductive joint 50 and the base body 30 conform to the specification of metal screw adapters of traditional tungsten bulbs for being connected with an external electric outlet. The conductive joint 50 is respectively electrically connected with the driving circuit unit 40 and the light emitting module 20, so that the driving circuit 40 can convert the voltage of the external electric outlet to provide the light-emitting diodes 22 with a desired voltage. The driving circuit unit 40 and the light emitting module 20 may be respectively electrically connected with the conductive joint 50 via electrical wires (not shown). It should be recognized that those skilled in the art are easy to know the electrical connection structure and the electrical connection mode isn't limited herein, so it is omitted.

The cover body 60 is located on one end of the heat radiator 10 while, and the plurality of second engaging parts 62 of the cover body 60 are received the plurality of grooves 13 of the heat radiator 10 (please refer to FIG. 5). The base body 30 is located on the other end of the heat radiator 10. The first engaging portions 321 of the first engaging parts 32 is configured to engage with the corresponding second engaging portions 621 of the second engaging parts 62 of the cover body 60. Consequently, the heat radiator 10 is sandwiched between the base body 30 and the cover body 60. Under this arrangement, the LED lamp assembly of the present invention could be assembled through a single assembly operation.

Further, the lens 70 is disposed in the through-hole 61 of the cover body 60. In one implementation, the first engaging portions 321 of the first engaging parts 32 are fasteners, and the second engaging portions 621 of the second engaging parts 62 are fastening holes. In another implementation, the first engaging portions 321 are fastening holes and the second engaging portions 621 are fasteners. After the LED assembly of the present invention is assembled, the light guiding portions 71 are correspondingly located in front of the light-emitting diodes 22.

The LED lamp assembly of the present invention at least has the advantages and functions as follows:

1. The LED assembly of the present invention is assembled through the engagement of the first engaging parts and the second engaging parts, thus saving the usage of large amount of screws and rivets to simplify the entire manufacturing process.

2. The LED assembly of present invention directly connects the first engaging parts of the base body and the second engaging parts of the cover body, and sandwiches the heat radiator between the base body and the cover body, rendering possible the manufacturing of the LED assembly in a single assembly operation.

What are disclosed above are only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention.

What is claimed is:

1. A LED lamp assembly, comprising:

a base body (30) having a plurality of first engaging parts disposed at intervals on an outer wall thereof, each of the first engaging parts having an integrally formed fastening hook protruding there-from;

a cover body (60) having a through-hole defined centrally thereon and a plurality of second engaging parts extending from an inner-facing surface thereof around the through-hole at intervals, each of the second engaging parts having a fastening hole aligningly configured to respectively receive the fastening hook of the first engaging part;

a heat radiator (10) defining a receiving portion in a central portion thereof and a plurality of grooves defined thereon that enables passage of the second engaging parts; and a light emitting module (20) having a circuit board and a plurality of light-emitting diodes disposed thereon arranged in the receiving portion;

wherein the second engaging parts respectively pass through the grooves of the radiator, and wherein each fastening hook of the first engaging parts directly engages the corresponding fastening hole of the second engaging parts, so that the heat radiator is sandwiched between the base body and cover body.

2. The LED lamp assembly as claimed in claim 1, wherein a plurality of radiating fins are arranged on a periphery of the heat radiator and extending outwardly from the periphery of the heat radiator.

3. The LED lamp assembly as claimed in claim 1, further comprising a conductive joint assembled on a rear end of the base body.

4. The LED lamp assembly as claimed in claim 1, wherein the light emitting module further includes a circuit board having a rear end face thereof attached to an inner wall of the receiving portion and a front end face thereof with the light-emitting diodes disposed thereon.

5. The LED lamp assembly as claimed in claim 1, further comprising a lens having a plurality of light guiding portions corresponding to the light-emitting diodes and disposed in the through-hole of the cover body.

6. The LED lamp assembly as claimed in claim 1, further comprising a driving circuit unit received in a receiving space of the base body.

7. The LED lamp assembly as claimed in claim 6, wherein the driving circuit unit includes at least one circuit board and a plurality of electronic components disposed on the circuit board.

* * * * *